US009539478B2

(12) United States Patent
Narita et al.

(10) Patent No.: US 9,539,478 B2
(45) Date of Patent: Jan. 10, 2017

(54) GOLF CLUB HEAD

(71) Applicant: Bridgestone Sports Co., Ltd., Tokyo (JP)

(72) Inventors: Tadahiro Narita, Tokyo (JP); Wataru Ban, Tokyo (JP); Atsushi Komatsu, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/689,692

(22) Filed: Apr. 17, 2015

(65) Prior Publication Data

US 2015/0352412 A1 Dec. 10, 2015

(30) Foreign Application Priority Data

Jun. 10, 2014 (JP) ..... 2014-119805

(51) Int. Cl.
*A63B 53/04* (2015.01)

(52) U.S. Cl.
CPC ..... *A63B 53/047* (2013.01); *A63B 53/0466* (2013.01); *A63B 53/0475* (2013.01); *A63B 2053/0408* (2013.01); *A63B 2053/0416* (2013.01); *A63B 2053/0429* (2013.01); *A63B 2053/0458* (2013.01); *A63B 2053/0462* (2013.01); *A63B 2209/00* (2013.01)

(58) Field of Classification Search
CPC ..... A63B 53/047; A63B 2053/0416; A63B 2053/0458; A63B 2053/0408; A63B 2053/0429; A63B 2209/00; A63B 53/0466; A63B 53/0475; A63B 2053/0462
USPC ..... 473/324–350, 287–292
See application file for complete search history.

(56) References Cited

U.S. PATENT DOCUMENTS

| | | | | |
|---|---|---|---|---|
| 708,575 | A * | 9/1902 | Mules | A63B 53/0466 473/329 |
| 2,429,351 | A * | 10/1947 | Fetterolf | A63B 53/04 473/329 |
| 3,084,940 | A * | 4/1963 | Cissel | A63B 53/04 273/DIG. 6 |
| 3,368,812 | A * | 2/1968 | Baldwin, Sr. | A63B 53/04 473/288 |

(Continued)

FOREIGN PATENT DOCUMENTS

| | | |
|---|---|---|
| JP | 58-166365 U | 11/1983 |
| JP | S61-13984 A | 1/1986 |

(Continued)

*Primary Examiner* — Sebastiano Passaniti
(74) *Attorney, Agent, or Firm* — Muncy, Geissler, Olds & Lowe, P.C.

(57) ABSTRACT

A golf club head includes a head body that has a recess part at a front portion thereof, a face plate that is in a plate shape and arranged in the recess of the head body, a front surface of the face plate being for hitting a ball, and an elastic body that is made of an elastically deformable material and intervenes between the head body and the face plate, the elastic body being fixed to the head body and the face plate so that the face plate is slidable in the recess with respect to the head body. A hardness of the material of the elastic body is ranged between Shore A Hardness 10 and Shore D Hardness 80 (inclusive), and a front side elastic body arrangement surface of the head body to which the elastic body is fixed is not parallel to the front surface of the face plate.

13 Claims, 14 Drawing Sheets

(56) References Cited

U.S. PATENT DOCUMENTS

| | | | | | |
|---|---|---|---|---|---|
| 4,884,808 | A * | 12/1989 | Retzer | A63B 53/04 | 473/288 |
| 5,083,778 | A * | 1/1992 | Douglass | A63B 53/0487 | 273/DIG. 10 |
| 5,141,231 | A * | 8/1992 | Cox | A63B 53/0466 | 473/330 |
| 5,398,929 | A * | 3/1995 | Kitaichi | A63B 53/04 | 473/329 |
| 5,403,007 | A * | 4/1995 | Chen | A63B 53/04 | 473/342 |
| 5,447,311 | A * | 9/1995 | Viollaz | A63B 53/04 | 473/329 |
| 6,001,030 | A * | 12/1999 | Delaney | A63B 53/0487 | 473/329 |
| 7,281,990 | B2 * | 10/2007 | Hagood | A63B 53/04 | 473/329 |
| 8,622,850 | B2 * | 1/2014 | Narita | A63B 53/0487 | 473/329 |
| 8,790,192 | B2 * | 7/2014 | Narita | A63B 53/0487 | 473/329 |
| 2011/0319188 | A1 * | 12/2011 | Narita | A63B 53/0487 | 473/329 |
| 2011/0319189 | A1 * | 12/2011 | Narita | A63B 53/0487 | 473/340 |

FOREIGN PATENT DOCUMENTS

| | | | |
|---|---|---|---|
| JP | H01-131682 | A | 5/1989 |
| JP | H5-305161 | A | 11/1993 |
| JP | 3091025 | U | 1/2003 |
| JP | 2006-198327 | A | 8/2006 |

* cited by examiner

GOLF CLUB HEAD

CROSS REFERENCE TO RELATED APPLICATION

The present application is related to, claims priority from and incorporates by reference Japanese Patent Application No. 2014-119805, filed on Jun. 10, 2014.

TECHNICAL FIELD

The present invention relates to a golf club head, particularly to a golf club head of which the face plate is arranged at the face part via an elastic body.

BACKGROUND

An iron type golf club head, as well known, includes a face part, which has a plate-shape face surface, and a hosel part, which is connected to the heel side of the face part. A shaft insertion hole is provided at the hosel part. A shaft is inserted into the shaft insertion hole and fixed with adhesive agent.

Patent Doc. 1 discloses a golf club head in which a hitting surface plate is glued to the hitting surface spot of the head body with a shock absorbing layer.

Patent Doc. 2 discloses a head in which a middle layer made of buffer material intervening at the face surface side of the head body.

As for wood type golf club heads for drivers or fairway woods, heads made of metal in a hollow shape are well known. In general, a wood type golf club head in a hollow shape includes a face part for hitting a ball, a crown part comprising the upper surface part, a sole part comprising a sole part of the golf club head, a side part comprising surrounding parts at the toe side, at the back side and at the heel side of the golf club head, a hosel part. As for the metal comprising the hollow shape golf club head, aluminum alloy, stainless or titanium alloy are used. In case of a driver, titanium alloy recently has been widely used.

Patent Doc. 3 describes a golf club head having an elastic body layer arranged at the face part of the head body and a fiber reinforced resin layer covering the surface of the elastic body.

PATENT DOCS

Patent Doc. 1: JP Utility Registration 3091025

Patent Doc. 2: JP Laid-Open Utility Publication S58-166365

Patent Doc. 3: JP Laid-Open Patent Publication H5-305161

Patent Doc. 4: JP Laid-Open Patent Publication 2006-198327

Patent Doc. 5: JP Laid-Open Patent Publication H01-131682

Patent Doc. 6: JP Laid-Open Patent Publication S61-13984

The invention is to provide a golf club head that is able to increase or decrease the backspin amount of golf ball by making a face plate slide upward or downward when hitting a golf ball.

SUMMARY

A golf club head disclosed in the application includes a head body that has a recess part at a front portion thereof, a face plate that is in a plate shape and arranged in the recess of the head body, a front surface of the face plate being for hitting a ball, and an elastic body that is made of an elastically deformable material and intervenes between the head body and the face plate, the elastic body being fixed to the head body and the face plate so that the face plate is slidable in the recess with respect to the head body. A hardness of the material of the elastic body is ranged between Shore A Hardness 10 and Shore D Hardness 80 (inclusive), and a front side elastic body arrangement surface of the head body to which the elastic body is fixed is not parallel to the front surface of the face plate. Preferably, a back surface of the face plate, to which the elastic body is fixed, is formed not to be parallel to the front surface of the face plate. Further, more preferably, the back surface of the face plate and the front side elastic body arrangement surface of the head body are parallel.

It is preferred that a thickness of the face plate decreases as it goes low.

It is preferred that the front and back surfaces of the face plate are both plane, and an intersectional angle θ, which is determined with the front and back surfaces of the face plate that are not parallel, is ranged between 2° and 70° (inclusive).

It is preferred that a thickness of the face plate increases as it goes low.

It is preferred that a thickness of the elastic body is even.

When the golf club head disclosed in the application is an iron type golf club head, it is preferred that an upper edge of the elastic body is arranged lower than an upper edge of the face plate.

In the present invention, The face plate is arranged at the face surface of the head with the elastic body in a fashion that the face plate is slidable along the face surface. The elastic body has its hardness ranged between Shore A Hardness 10 and Shore D Hardness 80 (inclusive). Therewith, when hitting a golf ball (at the impact), the face plate is able to slide upward or downward, causing the back spin amount of the golf ball to increase or decrease according to the moving direction of the face plate.

When a thickness of the face plate is smaller (decreases) as it goes low, a rear tilt angle of the face plate back surface is greater in comparison with the face plate having an even thickness, making the slide amount of the face plate, which is upward, at the impact greater, causing the back spin amount to decrease.

When the thickness of the face plate is greater (increases) as it goes low, the face plate back surface tilts forward, making the face plate downward at the impact, causing the back spin amount to increase.

BRIEF DESCRIPTION OF THE DRAWINGS

FIGS. 12A to 12C are perspective views. FIGS. 12D to 12F are sectional views respectively taken along D-D line in FIG. 12A, E-E line in FIG. 12B, F-F line in FIG. 12C.

DETAILED DESCRIPTION OF THE PREFERRED EMBODIMENTS

Figure 1:
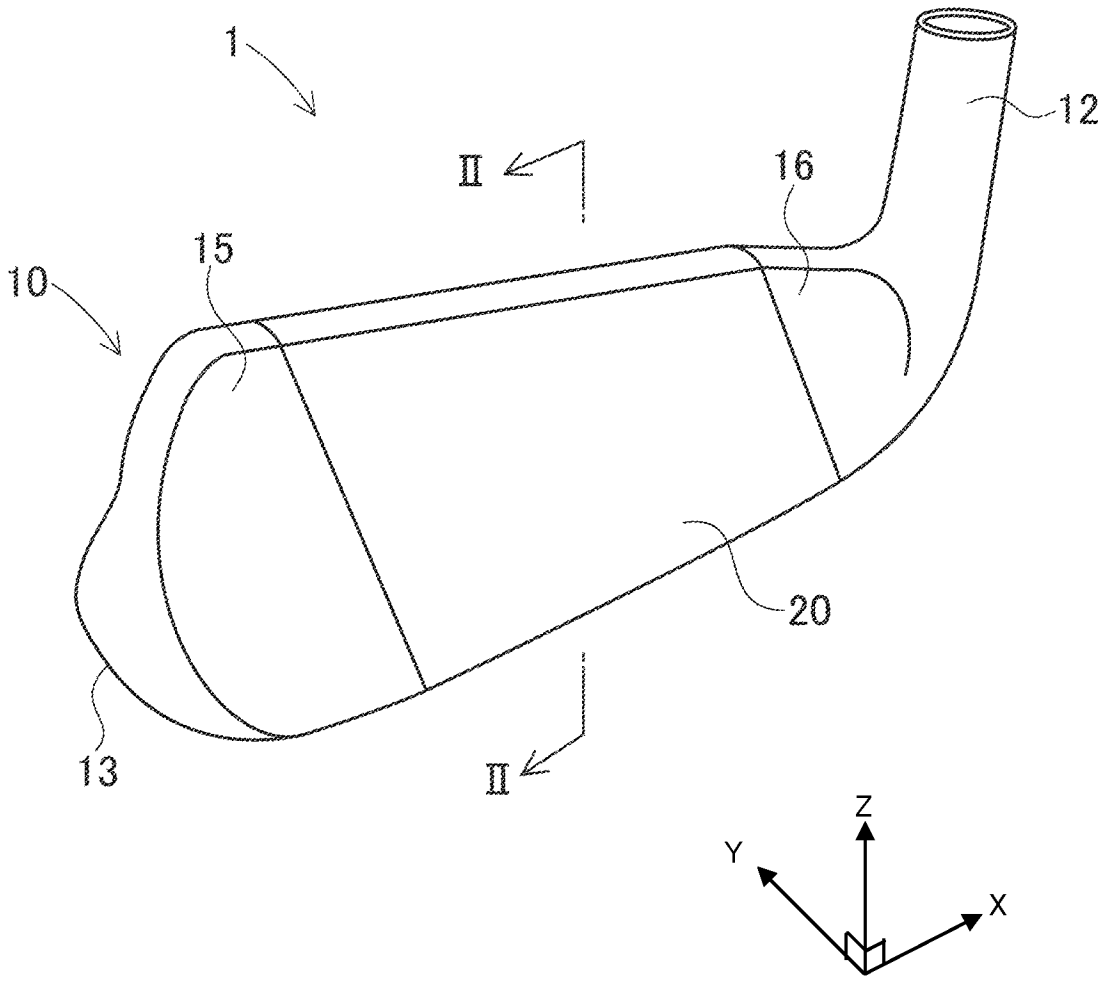
FIG. 1 is a perspective view illustrating an iron type golf club head of an embodiment.

Referring to FIGS. 1 to 4, an iron type golf club head 1 of the first invention is explained.

The iron golf club head 1 includes a head body 10 provided with a recess part 11 (see FIG. 3) at the face part and a face plate 20, which is in a plate shape, that is attached to the recess part 11 through an elastic body 30, the elastic body intervening between the head body 10 and the face plate 20.

In the embodiment, the head body 10 and the face plate 20 are made of metal material such as stainless steel or soft iron etc. A hosel part 12 is formed at a heel side of the head body 10.

The iron golf club head 1 is in a muscle back structure in which a lower part of the head body 10 has an expanded thick portion. In the lower part of the head body 10, the middle portion in the toe-heel direction is a plate shape part 14.

The recess part 11 is provided at the middle of the head body 10 in the toe-heel direction, extending from the top edge to the bottom edge. The width W11 of the recess part 11 in the toe-heel direction (X direction) is even with respect to the up-down direction (Z direction). In the front surface side of the plate shape part 14, the depth δ11 of the recess part 11 is smaller as it goes lower.

In an upper side than the plate shape part 14, the recess part 11 penetrates the head body 10 in the front rear direction (Y direction), respectively forming a toe side standing part 15 and a heel side standing part 16 at the toe side and the heel side of the recess part 11. Such a penetrating structure helps preventing the thickness of the upper head body from being too large.

The front surface of the plate shape part 14 in the recess part 11 is formed by an upward tilt surface. The front surface is to be a front side elastic body arrangement surface 17 on which the elastic body 30 is arranged. Further, the face plate 20 is arranged on the front surface 37 of the elastic body 30. The back surface of the face plate 20 is to be another elastic body arrangement surface 27 of the face plate 20, hereinafter a back surface elastic body arrangement surface. The surfaces 17 and 27 are parallel to each other. The elastic body 30 may be bonded to the front side elastic body arrangement surface 17 of the head body 10 and to the back side elastic body arrangement surface 27 of the face plate 20 using an adhesive agent. The width W20 of the face plate 20 in the toe-heel direction is formed to be the same as or to be slightly smaller than the width W11 of the recess part 11 in order to allow the face plate 20 to slide along the toe side and heel side standing parts 15 and 16. By arranging the face plate 20 in the recess part 11 to be supported (or contacted) only with the elastic body 30 in a static state, the face plate 20 is able to more easily slide. In the structure where the face plate 20 is arranged in the recess part 11 through the elastic body 30, the top edge of the face plate 20 smoothly continues to the top edge of the head body 10. The bottom edge of the face plate 20 also smoothly continues to the bottom edge of the head body 10. In the same structure, the front surface 28 of the face plate 20 and the front surfaces of the toe and heel side standing parts 15 and 16 are placed on the same plane. Although the illustrations are eliminated from the drawings, a plurality of grooves (or score lines) are formed on the front surface 28 of the face plate 20.

The back surface elastic body arrangement surface 27 that is the back surface of the face plate 20 is arrange not to be parallel to the front surface 28 of the face plate 20 but to incline (rearward tilt). Regarding the tilt angle θ20 of the back surface elastic body arrangement surface 27 of the face plate 20 with respect to the front surface 28 of the face plate 20, the lower limit is 2 degrees or more, preferably 10 degrees or more. The upper limit is 70 degrees or less, preferably 60 degrees or less. The tilt angle θ20 is formed with two flat surfaces of the face plate, being defined as an intersectional angle. When the tilt angle is too small (for example less than 10 degrees), the sliding effect of the face plate 20 as well may be too small. When the tilt angle is too large (for example more than 70 degrees), negative side effects may be raised on the head design, for example the total weight of the head becomes large.

Figure 2B:
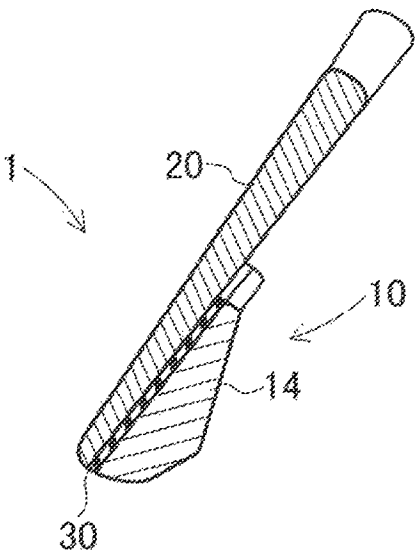
FIG. 2B is a sectional view taken along with II-II line in FIG. 1.
Figure 2A:
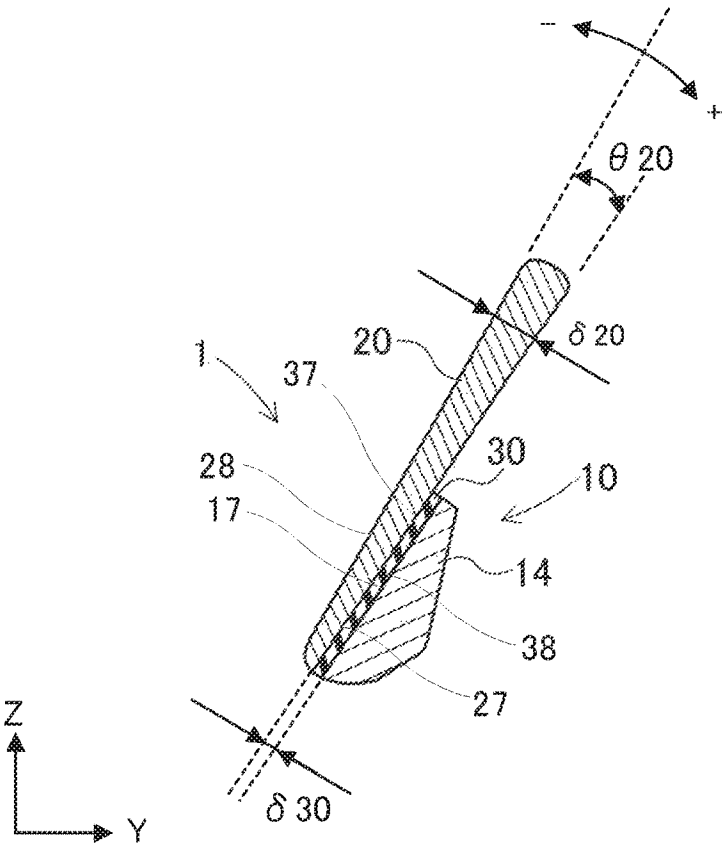
FIG. 2A is an end view of cutting portions taken along with II-II line in FIG. 1.

In the invention, the tilt angle θ20 is determined with respect to the front surface 28 of the face plate 20. In the view from the heel side as shown in FIG. 2A, when the angle rotates to the clockwise direction, it is defined to be a rearward tilt, see FIGS. 2A and 12C. When the angle rotates to the anti-clockwise direction, it is defined to be a frontward tilt, see FIGS. 8 to 11 and FIG. 12B.

The thickness δ20 of the face plate 20 gradually becomes small from the top edge part to the bottom edge part. Regarding the thickness of the face plate 20 at the bottom edge of the face plate 20, the lower limit is 1 mm or more, preferably 3 mm or more, the upper limit is 7 mm or less, preferably 5 mm or less. When the thickness of the face plate 20 is too small, the strength of the head may be insufficient. On the other hand, when the thickness of the face plate 20 is too large, the sliding effect of the face plate 20 may decrease or cause the head weight to exceed the adequate range. Regarding the widths of the recess part 11 and face plate 20 in the toe-heel direction, there is not any limitation, the lower limit is 10 mm or more, preferably 20 mm or more. The upper limit is 100 mm or less.

Regarding the hardness of the material of the elastic body 30, the lower limit is Shore A hardness 10 or more, preferably Shore A hardness 30 or more. The upper limit is Shore A hardness 80 or less, preferably Shore A hardness 70 or less. When the hardness is too small, the adhesive force to the face plate or the head body may deteriorate. When the hardness is too large, the sliding effect may not be obtained. For the material of the elastic body 30, any materials that are made from rubber or resin etc. can be available. As for the rubber, natural rubbers, polybutadiene rubbers, styrene butadiene rubbers, isoprene rubber s etc. are listed for example.

As for the resin, ionomer resins, urethane resins, polyester resins, polyamide resins etc. are listed for example. Particularly, urethane resins are preferred. Regarding the thickness of the elastic body 30, the lower limit is 0.1 mm or more, preferably 0.3 mm or more. The upper limit is 5 mm or less, preferably 3 mm or less. When the thickness δ30 is too small, it may be difficult to achieve the sliding effect. When the thickness δ30 is too large, the initial velocity of golf ball may be lowered too much. In the embodiment, the thickness δ30 of the elastic body 30 is entirely even. The thickness may vary at particular portions. The thickness of the elastic body 30 is measured in a direction perpendicular to the back surface elastic body arrangement surface 27 of the face plate 20 or to the front side elastic body arrangement surface 17 of the head body 10.

Figure 2C:
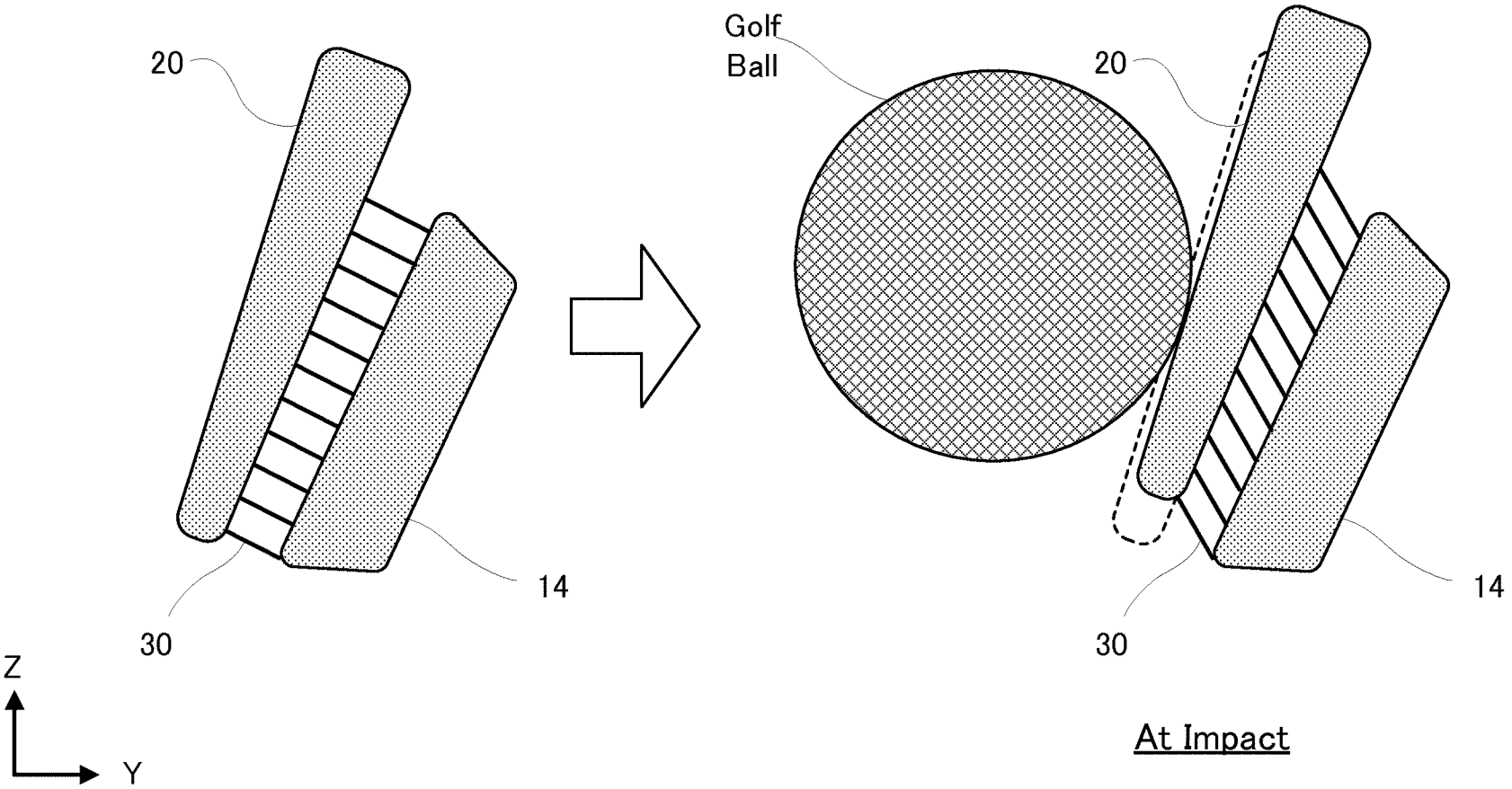
FIG. 2C illustrates a shear deformation of elastic body 30 in a plain model.
Figure 3:
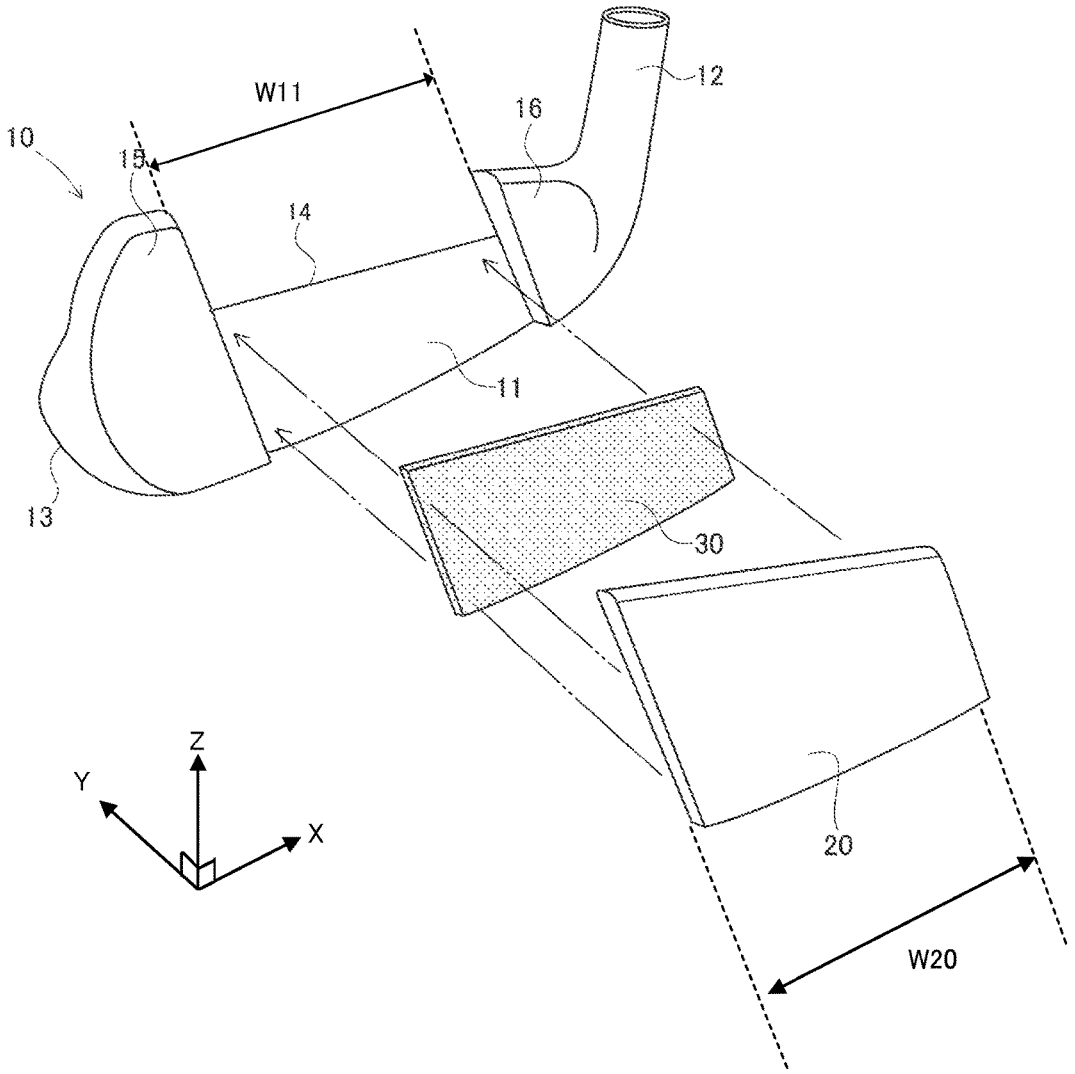
FIG. 3 is an exploded and perspective view of the golf club head in FIG. 1.
Figure 4:
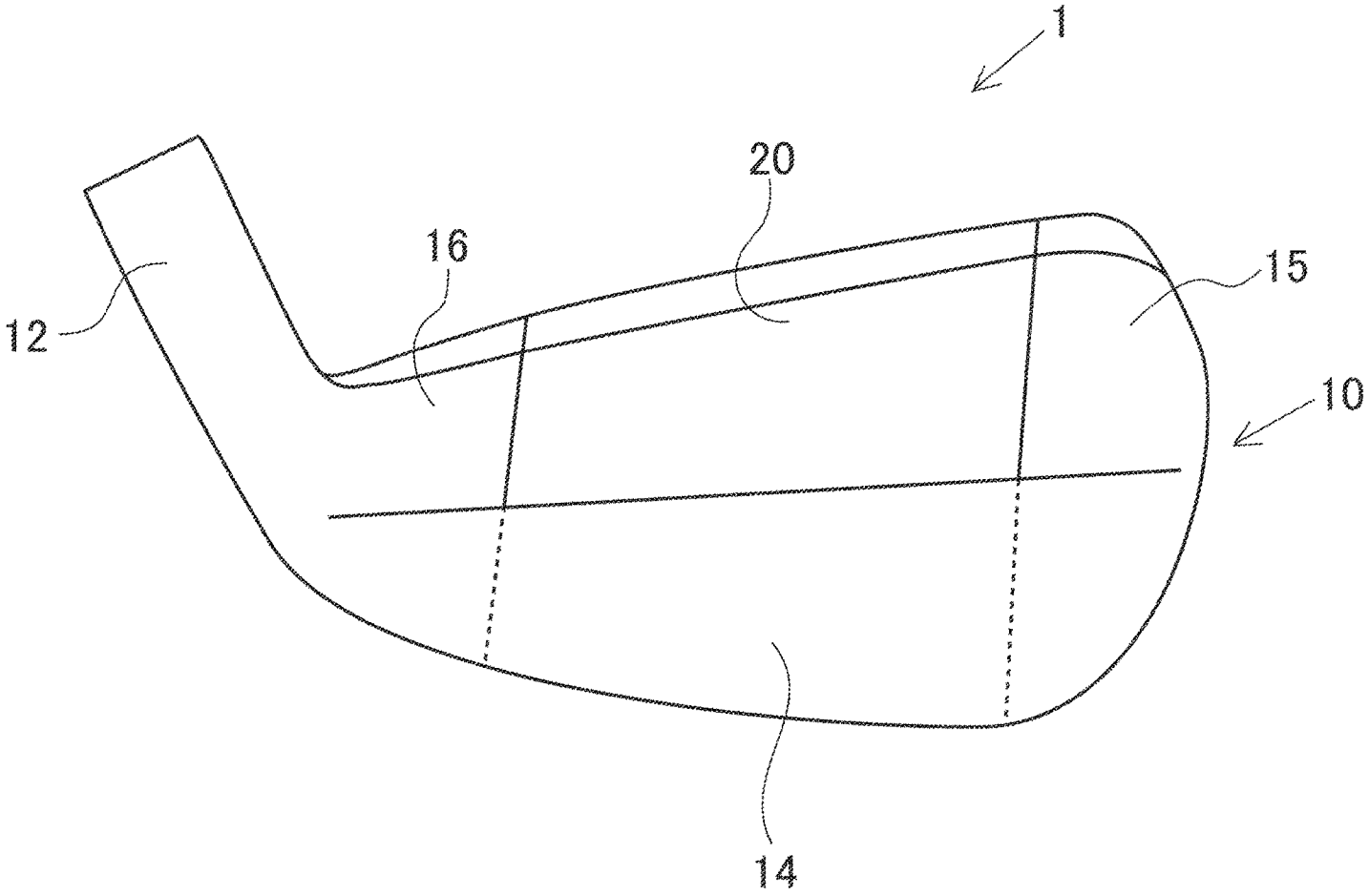
FIG. 4 is a back view of the golf club head in FIG. 1.

In the golf club head having the iron golf club head 1 that is comprised in such a manner, at the impact hitting a ball, the elastic body 30 does a shear deformation along the recess part 11. Namely, since the back surface elastic body arrangement surface 27 of the face plate 20 inclines at θ20 compared with the front surface 28 of the face plate 20, the face plate 20 is configured to easily slide upward when hitting the ball. Due to the movement of the face plate 20, the back spin amount generated on the ball decreases, resulting in a longer driving distance. When the discussed iron type golf club structure is adopted to middle or long iron clubs, longer driving distance can be achieved due to the reduction of the back spin amount. The share deformation is shown in FIG. 2C. The left is for before hitting (or the static state). The right is for at impact.

Figure 5A:
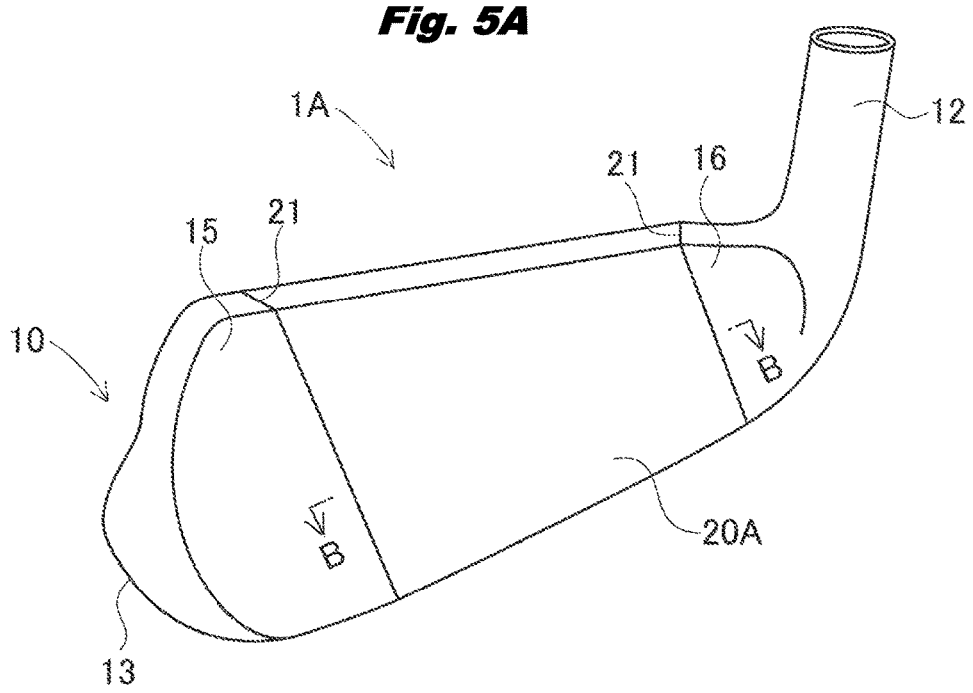
FIG. 5A is a perspective view illustrating an iron type golf club head of another embodiment.
Figure 5B:
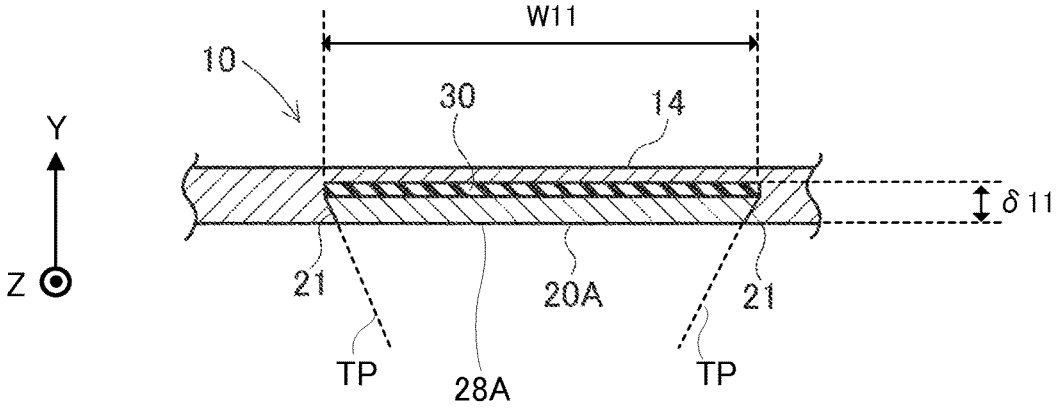
FIG. 5B is a sectional view taken along B-B line in FIG. 5A.

Referring to FIGS. 5A and 5B, a golf club head 1A according to another embodiment is to be explained. In the 1A, side edge surfaces 21 of a face plate 20A both have a tapered shape in which the toe-heel direction width of the face plate 20A decreases as it approaches a front surface 28A of the face plate 20A. Corresponding to the tapered shape of the face plate 20A, side parts of the recess part 11 in the width direction are formed in an under-cut shape. The angles by the tapered side edge surfaces 21 and the under-cut shape formed at the side parts of the recess part 11 are denoted with TP in FIG. 5B. With the structure, the face plate 20A is prevented from dropping off of the face surface toward the perpendicular direction.

Additionally, although not shown in the drawings, in order to prevent the face plate from dropping off, projection rail parts at side edge surfaces on the rear edge side in the toe-heel direction of the face plate may be arranged, and recess rail parts, which respectively mate with the projection rail parts in a slidable fashion, may be provided.

Further, means for connecting the face plate and the head body, which does not affect the sliding movement of the face plate up and down directions and which is other than the above embodiments, may be used. For example, the face plate and the elastic body are connected with screws at the toe side and the heel side, but the elastic body and the head body are not connected with screws.

Figure 6:
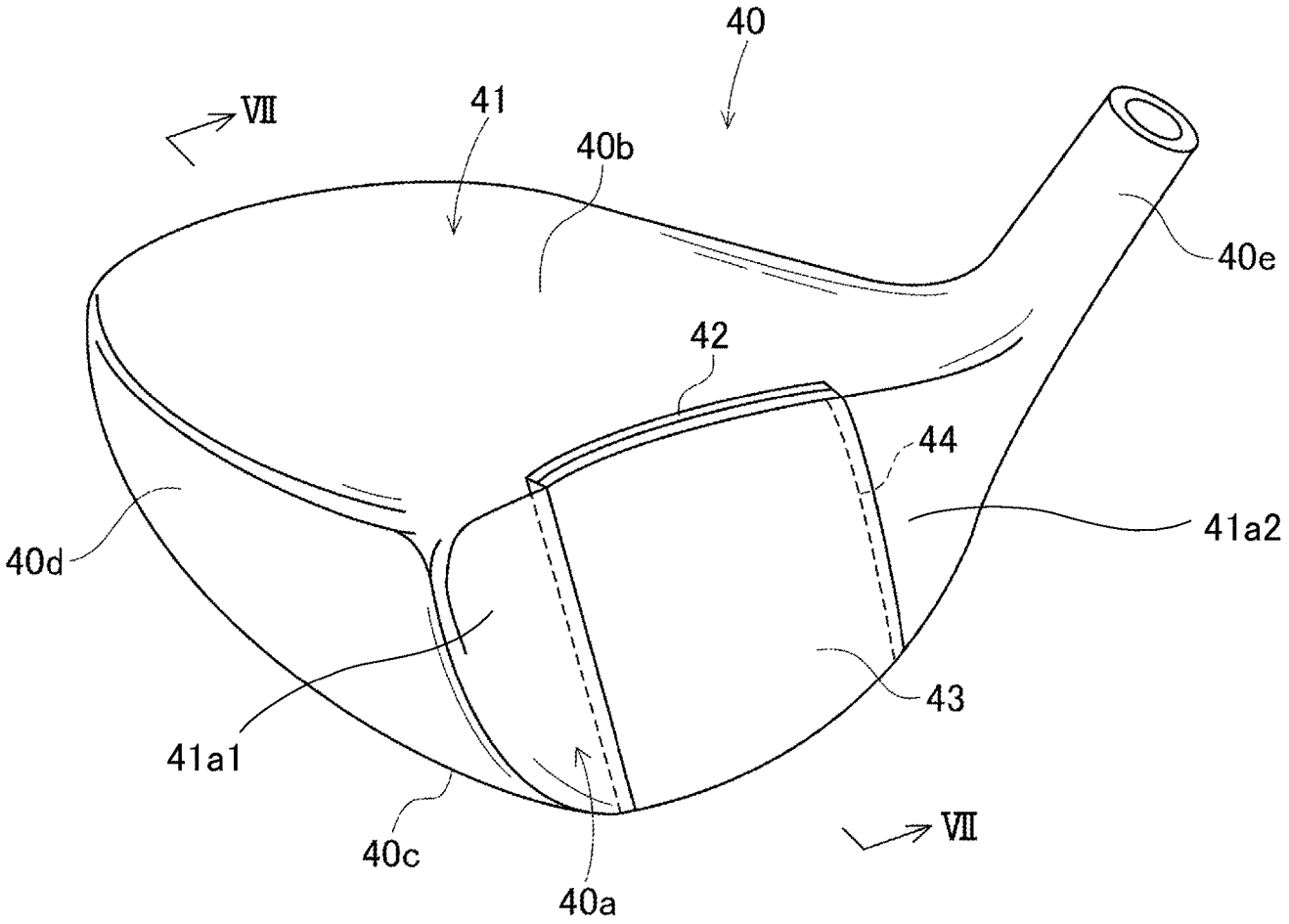
FIG. 6 is a perspective view of a wood type golf club head of another embodiment.
Figure 7:
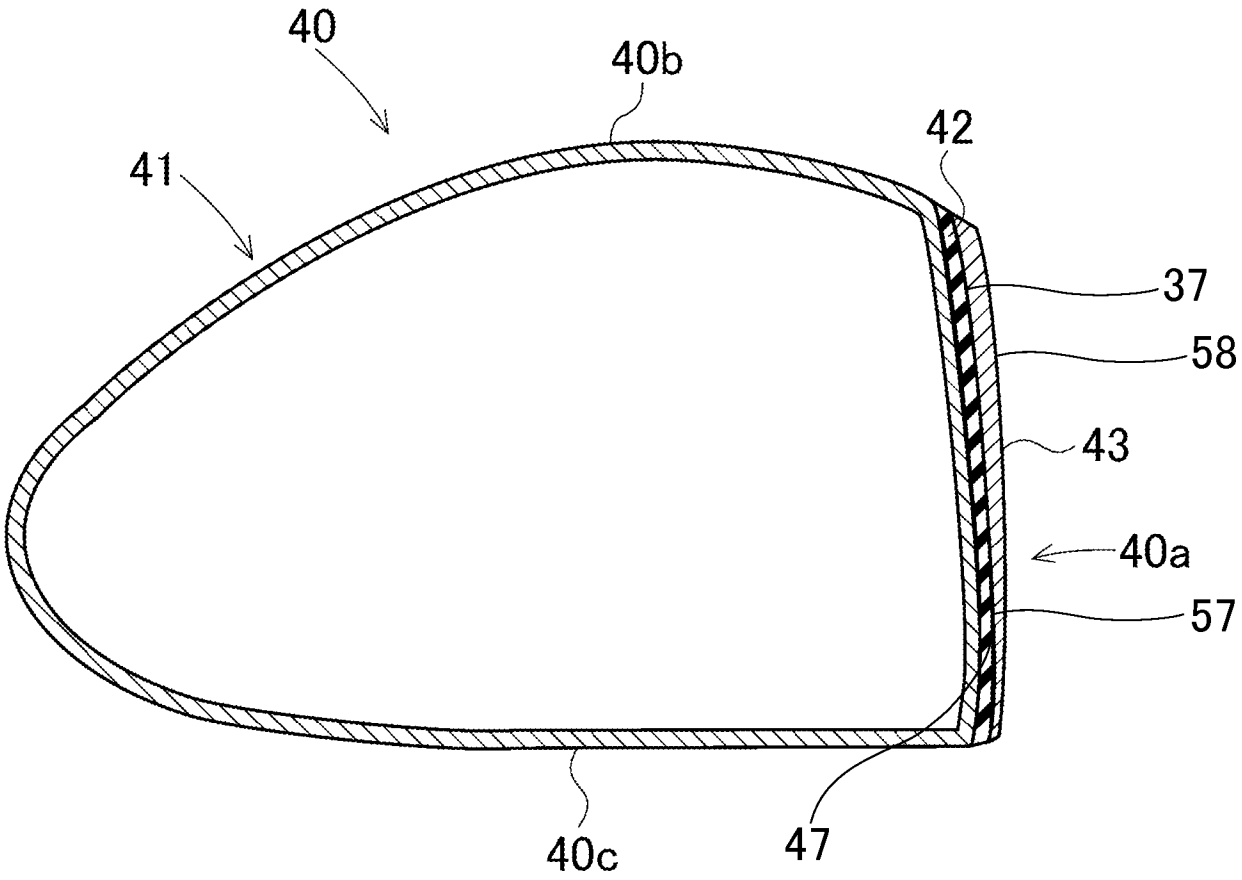
FIG. 7 is a sectional view taken along VII-VII line in FIG. 6.

The above embodiments relate to an iron type golf club head. The invention can be applied to a wood type golf club head or utility type golf club head as well. FIGS. 6 and 7 illustrate a wood type golf club head 40. The wood golf club head 40 is in a hollow shape, having a face part 40*a*, crown part 40*b*, sole part 40*c*, side part 40*d* and hosel part 40*e*.

The wood golf club head 40 is comprised with a head body 41, an elastic body 42, and a face plate 43. The head body 41 and the face plate 43 are made of titanium alloy, but not necessarily limited to the material.

At the middle of the face part 40*a* in the toe-heel direction, a recess part 44 extending the up and down direction is formed. An elastic body 42 is arranged in the recess part 44. A face plate 43 is arranged on a front surface 37 of the elastic body 42. A front side elastic body arrangement surface 47 of the head body 41 and a back side elastic body arrangement surface 57 of the face plate 43 are parallel. The elastic body 42 may be fixed, by an adhesive agent, to the front side elastic body arrangement surface 47 of the head body 41 and the back side elastic body arrangement surface 57 of the face plate 43. As shown in FIG. 7, in the sectional view in the toe-heel direction, the face plate 43 and the recess part 44 accommodating the face plate 43 are reached to the sole part 40*c* from the crown part 40*b*.

The back side elastic body arrangement surface 57 of the face plate 43 is not parallel to the front surface 58 of the face plate 43, but inclines (rearward). Regarding the tilt angle of the back side elastic body arrangement surface 57 of the face plate 43 with respect to the front surface 58 of the face plate 43, the lower limit is 2 degrees or more, preferably 10 degrees. The upper limit is 70 degrees or less, preferably 60 degrees or less. When the tilt angle is too small, the sliding effect may be too small. When the tilt angle is too large, negative side effects may be raised on the head design, for example the total weigh of the head becomes large.

In the embodiment, the front side elastic body arrangement surface 47 of the head body 41, the back side elastic body arrangement surface 57 of the face plate 43 and the front surface 58 of the face plate are in curved shapes having curvatures. Specifically, these curvatures gradually vary from the crown to the sole. These above tilt angles are determined at several locations of which tilt angles properly represent the features of the head. For example, one of the featured locations is the middle of the face plate 58 in height. The other is a so-called sweet spot on the front surface of the face plate, from which a perpendicular line is drawn passing through the gravity center of the head.

The depth of the recess part 44 becomes smaller as it goes lower. The thickness of the face plate 43 becomes smaller as it goes lower. The width of the face plate 43 in the toe-heel direction is formed to be the same as or to be slightly smaller than the width of the recess part 44 in order to allow the face plate 43 to slide along the front surface 37. By arranging the face plate 43 to be supported (or contacted) only with the elastic body 42 in a static state, the face plate 43 is able to more easily slide.

Regarding the widths of the face plate 43 and the recess part 44, the lower limit is 10 mm or more, preferably 20 mm or more. The upper limit is 120 mm or less. The thickness of the elastic body 42 is as a whole even. Regarding the thickness of the elastic body 42, the lower limit is 0.1 mm or more, preferably 0.3 mm or more. The upper limit is 5 mm or less, preferably 3 mm or less. When the thickness is too small, the sliding effect may be too small. When the thickness is too large, the initial velocity of golf ball may be lowered too much.

In a state where the face plate 43 is inserted to the head through the elastic body 42, the front surface 58 of the face plate 43 and front surfaces 40*a*1 and 40*a*2 of the face part 40*a*, which are at the toe side and the heel side, are placed on the same plane. In the embodiment, the thickness of the elastic body 42 is formed even as a whole. The thickness, however, may partially vary.

Similar to the previous embodiment, when a golf ball is hit by the golf club head including the wood golf club head 40, the face plate 43 slides upward at the impact, the back spin of the ball decreases, enhancing the driving distance.

Figure 8:
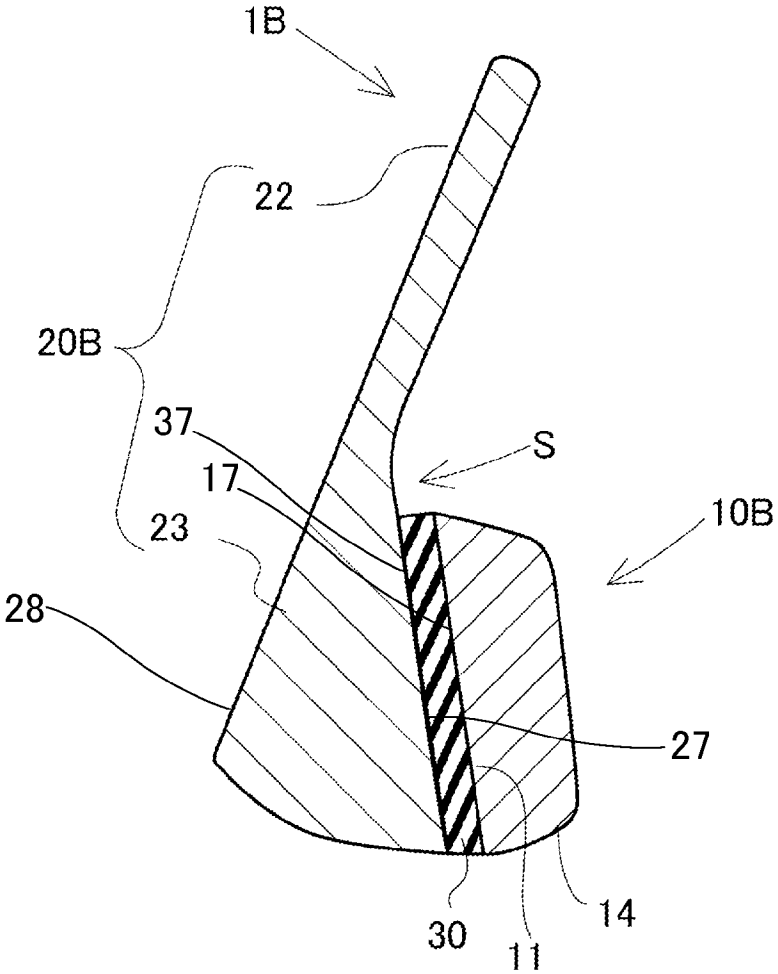
FIG. 8 is a sectional view of an iron type golf club head of another embodiment.

Referring to FIG. 8, another iron type golf club head 1B of another embodiment related to the second invention is to be explained.

The 1B includes a head body 10B in which a recess part 11 is formed at the face part and a face plate 20B that is inserted in the recess part 11 of the head body 10B through an elastic body 30. Assuming that the face plate 20 is divided into two pieces in height, the thickness of the upper part 22 is formed substantially uniform in the up down direction. The lower part 23 of the face plate 20B gradually decreases as it goes from the lower edge part toward the up. Regarding the thickness of the 23 at the bottom of the face plate 20B, there is no particular limitation. The lower limit, however, is 1.5 mm or more, preferably 3 mm or more. The upper limit is 15 mm or less, preferably 10 mm or less. Regarding the thickness of the 22 at the top of the face plate 20B, there is no particular limitation. The lower limit, however, is 1 mm or more, preferably 2 mm or more. The upper limit is 5 mm or less, preferably 4 mm or less.

The front surface of a plate shape part 14 is an inclined surface facing downward. The front surface of the plate shape part 14 is the front side elastic body arrangement surface 17 on which the elastic body 30 is arranged. On the front surface 37 of the elastic body 30, the lower part 23 of the 23 is arranged. The back surface elastic body arrangement surface 27 of the face plate 20B and the front side elastic body arrangement surface 17 of the head body are arranged parallel. The elastic body 30 may be fixed to the front side elastic body arrangement surface 17 of the head body and the back surface elastic body arrangement surface 27 of the face plate 20B with an adhesive agent.

The length of the back surface elastic body arrangement surface 27 of the face plate 20B in the up down direction is greater than the length of the front side elastic body arrangement surface 17 of the head body in the up down direction. A space S is provided between the upper part 22 and the plate shape part 14. Therewith, when the face place 20B slides downward, the upper part 22 does not contact to the plate shape part 14 or the elastic body 30.

The back surface elastic body arrangement surface 27 of the face plate 20B is not parallel to the front surface 28 of the face plate 20B, but inclines (forward tilt). Regarding the back surface elastic body arrangement surface 27 of the face plate 20B with respect to the front surface 28 of the face plate 20B, the lower limit is 2 degrees or more, preferably 10 degrees or more. The upper limit is 70 degrees or more, preferably 60 degrees or more. When the tilt angle is too small, the sliding effect may not be obtained. When the tilt angle is too large, negative side effects may be raised on the head design, for example the total weigh of the head becomes large.

The other compositions of the 1B are the same as the golf club head 1 or 1A.

In the golf club having the 1B that is comprised in such a manner, because the front side elastic body arrangement surface 17 of the head body is the inclined surface facing downward, the elastic body 30 does a shear deformation along the recess part 11, causing the face plate 20B to slightly slide downward. Namely, the back surface elastic body arrangement surface 27 of the face plate 20B inclines forward more than the front surface 28 of the face plate 20B, and the face plate 20B is configured to easily slide downward at the impact. Due to the movement of the face plate 20B, the back spin amount generated on the ball increases, causing the ball to more desirably stop. When the discussed iron type golf club structure is adopted to middle or short iron clubs, the back spin amounts increase, the ball can be stayed near from a landing spot where the ball lands.

Figure 9:
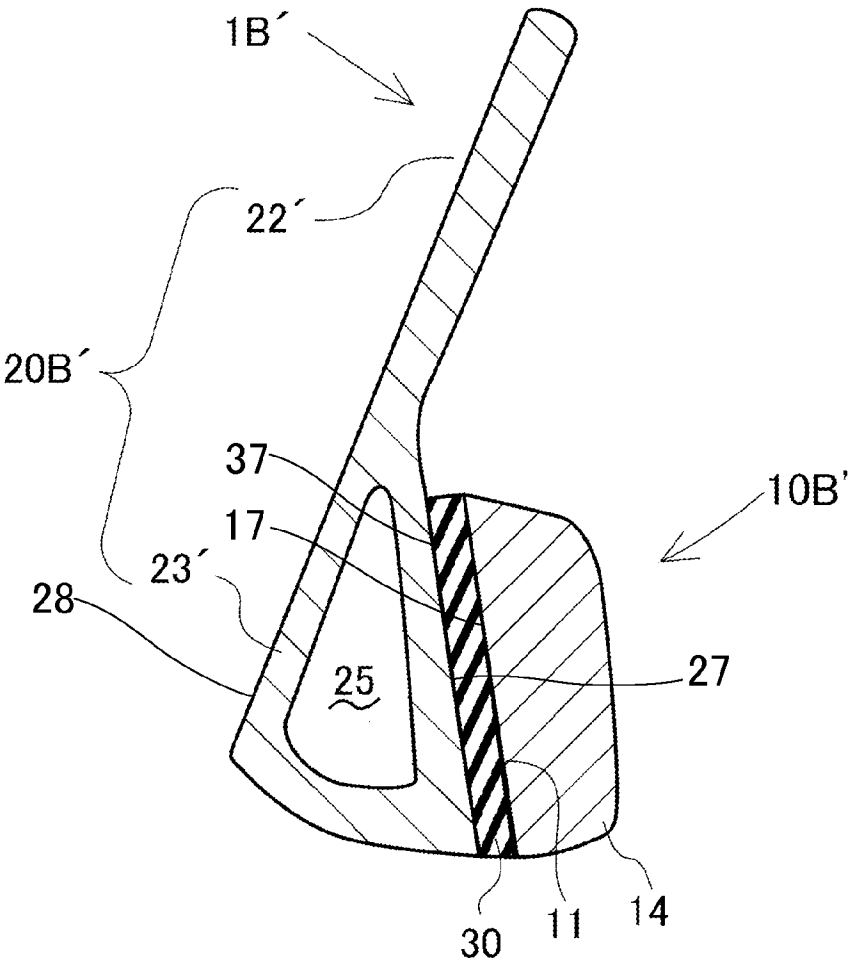
FIG. 9 is a sectional view of an iron type golf club head of another embodiment.

Referring to FIG. 9, another iron type golf club head 1B' of another embodiment is to be explained. In the golf club head 1B', a hollow structure is adopted, in which a hollow part 25 is formed in a lower part 23B' of a face plate 20B', making the face plate 20B' with a lighter weight. Using the golf club head 1B', the same effects are achieved as the golf club head 1B has.

Figure 10:
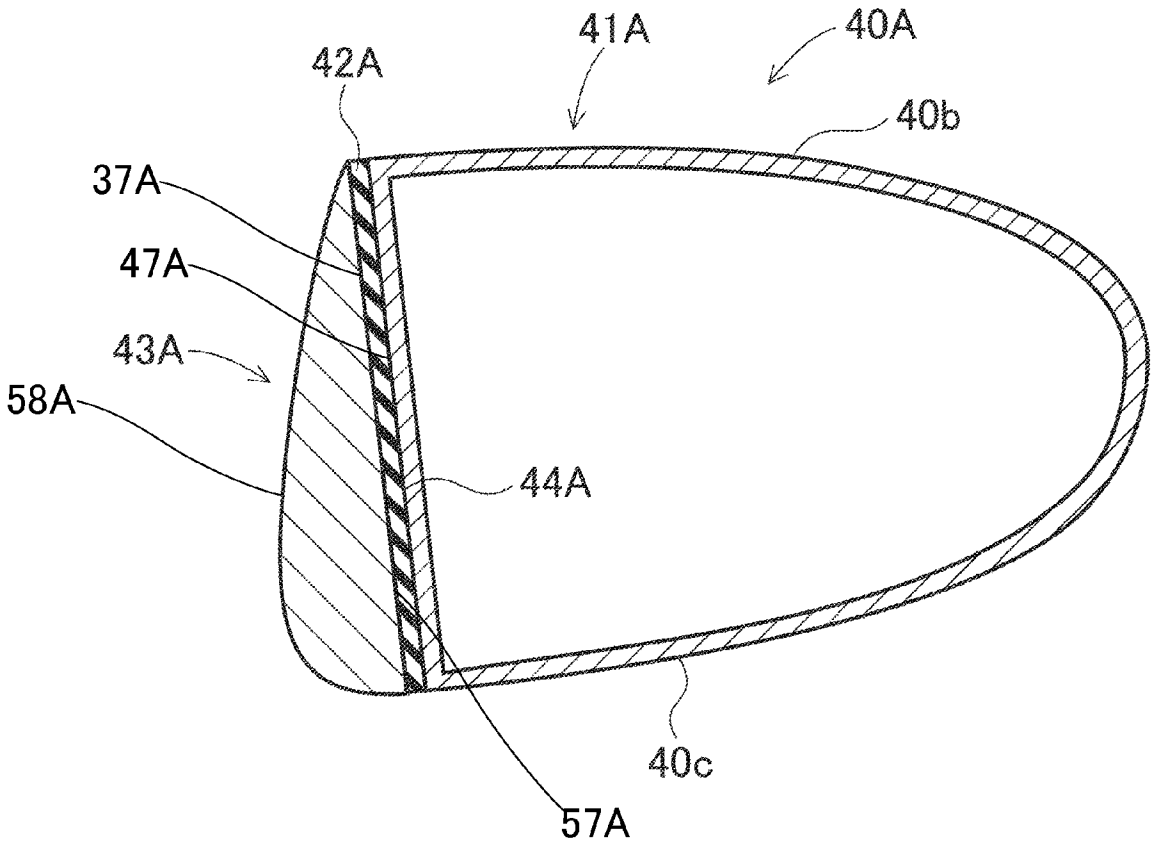
FIG. 10 is a sectional view a wood type golf club head of another embodiment.
Figure 11:
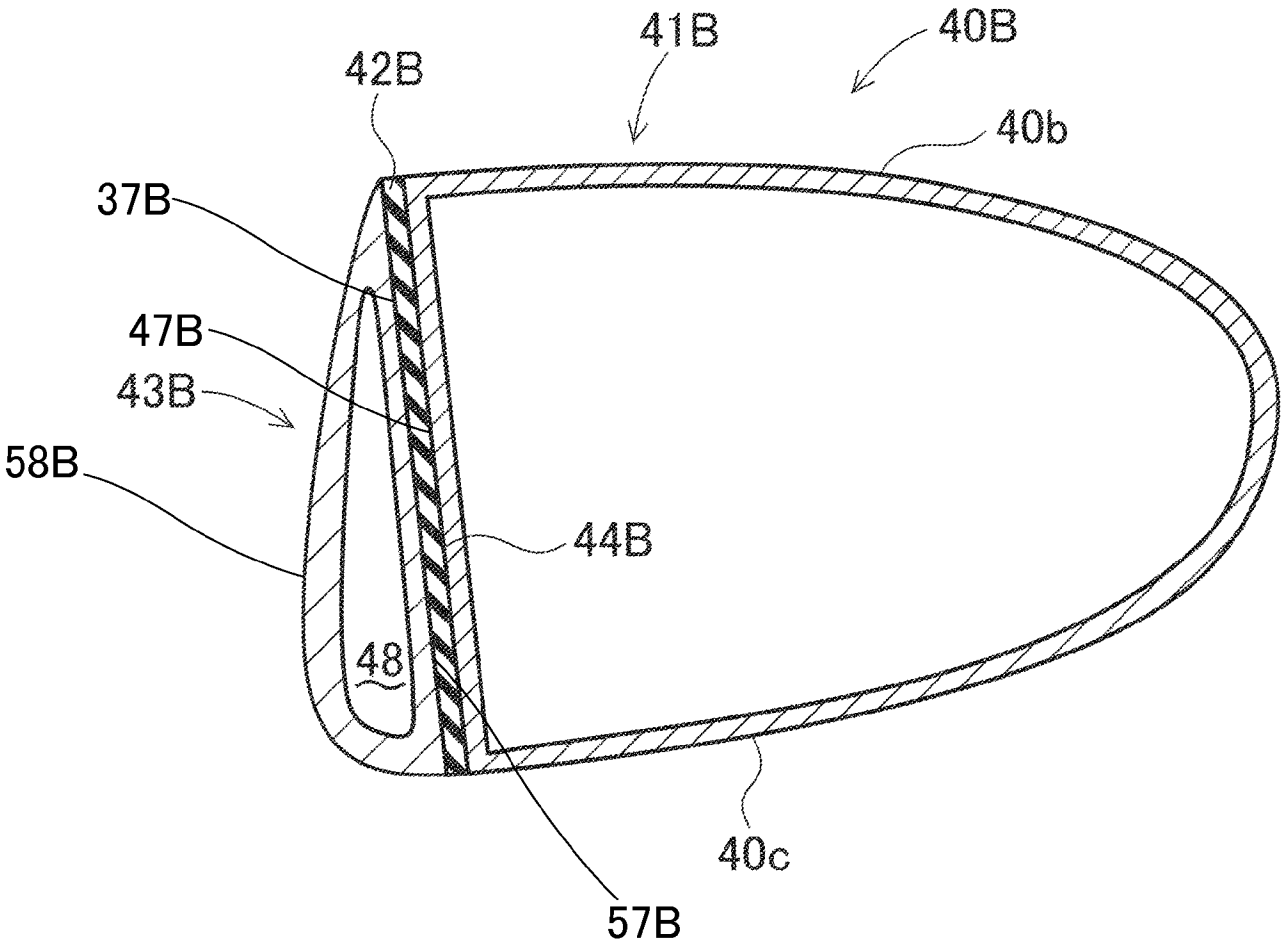
FIG. 11 is a sectional view a wood type golf club head of another embodiment.

The embodiments shown in FIG. 8 and FIG. 9 relate to iron type golf club heads. The second invention, however, may be applied to a wood type golf club head or utility type golf club head. FIG. 10 and FIG. 11 illustrate wood type golf club heads 40A and 40B. In the face plate 43A of the golf club head 40A in FIG. 10, there is no hollow portion inside. On the other hand, the golf club head 40B in FIG. 11 is in a hollow structure having a hollow part 48 of the face plate 43B, making the face plate 43 with a lighter weight.

The golf club head(s) 40A, 40B is comprised with a head body 41A, 41B, an elastic body 42A, 42B and a face plate 43A, 43B. The head body 41A, 41B and face plate 43A, 43B are made of titanium alloy. They, however, are not limited to the material. Regarding the hardness of material of the elastic body 42A, 42B, the lower limit is Shore A hardness 10 or more, preferably Shore A hardness 30 or more. The upper limit is Shore D hardness 80 or less, preferably Shore D hardness 70 or less.

The front surface of the head body 41A, 41B is formed with a downward tilt surface. A recess part 44A, 44B, which extends in up and down direction, is provided on the front surface. The front surface of the recess part 44A, 44B is to be and an elastic body arrangement surface 47A, 47B of the head body, on which the elastic body 42A, 42B is arranged. The face plate 43A, 43B is arranged on the front surface 37A, 37B of the elastic body 42A, 42B. The elastic body arrangement surface 47A, 47B and the elastic body arrangement surface 57A, 57B that is a back surface of the face plate 43A, 43B are parallel. The elastic body 42A, 42B may be fixed to the elastic body arrangement surface 47A, 47B and to the elastic body arrangement surface 57A, 57B that is the back surface of the face plate 43A, 43B with an adhesive agent. The face plate 42A, 43B and the recess part 44A, 44B are formed extending from the front edge of the crown part 40*b* to the front edge of the sole part 40*c*.

The depth of the recess part 44A, 44B becomes larger as it goes lower. The thickness of the face plate 43A, 43B becomes smaller as it goes upper. The elastic body arrangement surface 57A, 57B of the back surface of the face plate 43A, 43B is not parallel to but is inclined (forward tilt) to the front surface 58A, 58B of the face plate 43A, 43B. The face plate 43B is in a solid structure. The face plate 43B is in a hollow structure in which a hollow part 48 is formed.

Even in a case where a user hits a golf ball with the golf club having the golf club head 40A, 40B, the face plate 43A, 43B slides downward at the impact, and the back spin amount increases, causing the golf ball to more effectively stop (or sit). When adopting the wood type golf club head 40A, 40B according to the embodiment into a fairway wood,

EXAMPLES

Figure 12A:
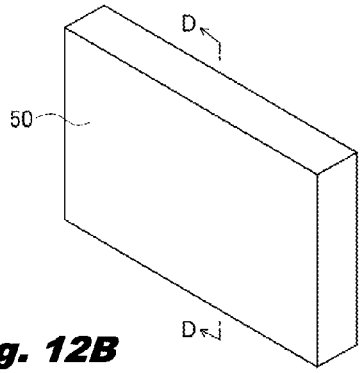
FIGS. 12A to 12F are structural views of plates used in experiments.
Figure 12B:
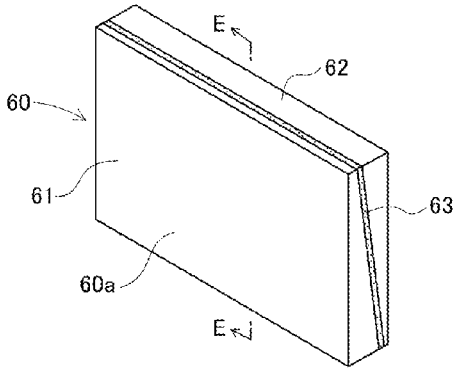
Figure 12C:
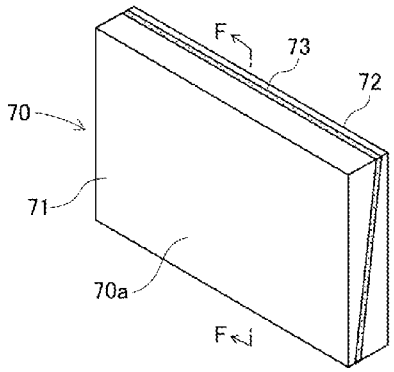
Figure 12D:
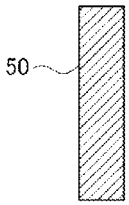

[Experiment 1] A rectangle plate 50 made of titanium shown in FIGS. 12A and 12D (80 mm W×80 mm H×5.8 mm T) is fixed to a base (not shown) by holding the four corners with screws in such a manner that the front surface 50*a* is inclined at angle α with respect to the vertical surface. The angle α is illustrated in FIG. 12G. Impacting golf balls ("X01Z" or "PHYZ 2013 Year" made by Bridgestone Sports) to the front surface of the titanium plate under condition where the velocity was 43 m/s, and the initial velocity, launch angle and spin amount of the rebounding balls were measured. The results are shown in Table 1. The angles α to be tested were 5°, 10° and 15 (only 5° for PHYZ ball). The ball is set to be horizontally shot toward the plate in the experiments.

Figure 12E:
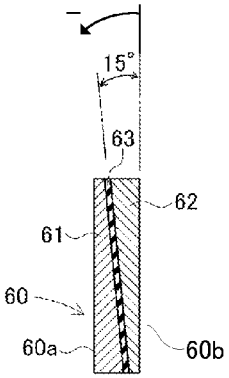

[Experiment 2] Titanium plates 61 and 62 shown in FIGS. 12B and 12E were affixed as putting the resin plate 63 having the thickness of 0.5 mm therebetween, forming a hybrid plate 60 having the same size as the titanium plate 50. The plate 60 was used. The hybrid plate 60 was fixed in a manner that the front surface 60*a* inclines rearward as Experiment 1. In the same manner, balls were impacted against the plate 60, and the initial velocity, launch angle and spin amount of the rebounding balls were measured. The angle α was 5°. The result is shown in Table 1. For the resin plate 63, urethane resin plates of Shore D Hardness 30 and Shore D Hardness 68 were used. For the affixing titanium plates 61, 62 and the resin plate 63, an epoxide-based adhesive agent was used.

The titanium plates 61 and 62 are in an identical shape. The affixing surface was angled at 15° with respect to the hybrid plate rear surface 60*b*, which is parallel to the front surface 60*a* of the hybrid plate. The affixing surface faces downward when the hybrid plate front surface stands upright, is inclined at 15° forward with respect the vertical surface (−15° tilt rearward).

In the impact experiment, the hybrid plate front surface 60*a* is set as inclining only at 5° with respect to the vertical surface. The rearward tilt angle of the resin plate front surface (or the affixing surface) was −10° (=α−15°). When the rearward tilt angle of the resin plate front surface was negative, it means that the front surface of the resin plate was facing downward.

Figure 12F:
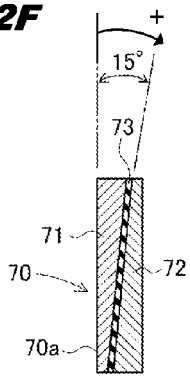
Figure 12G:
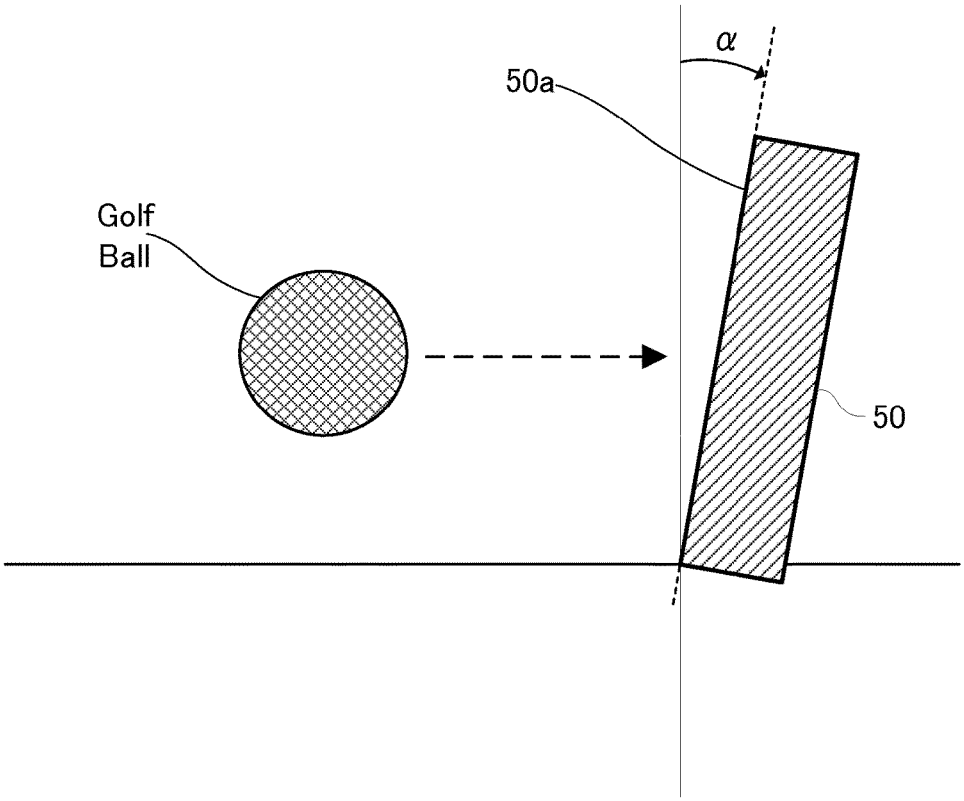
FIG. 12G illustrates angle α that is formed between a vertical line and a front surface of a titanium plate 50.

As shown in FIGS. 12C and 12F, another hybrid plate 71 was used for Experiment 3. Experiment 3 is the same as Experiment 2 except for using the hybrid plate 70 instead of using the hybrid plate 60. The hybrid plate 70 was formed by affixing titanium plates 71 and 72, putting the resin plate 73 therebetween. Under the same condition except for the hybrid plate 70, balls were impacted against the plate 70, and the initial velocity, launch angle and spin amount of the rebounding balls were measured. The angles α to be tested were 5°, 10° and 15 (only 5° for PHYZ ball).

The hybrid plate 70 was in the same structure and by the same material as the hybrid plate 60 shown in FIGS. 12B and 12E except for placing the plate by flipping up-side down. In a state where the front surface 70*a* of the hybrid plate 70 stands upright, the affixing surface face upward rather than the vertical surface, the angle was 15°.

In the impact experiments, since the hybrid plate front surface 70*a* were placed to incline rearward only at the angle α=5°, 10°, and 15° with respect to the vertical surface, the rearward tilt angles of the resin plate front surface (affixing surface) were 20°, 25° and 30° (=α+15°). When the rearward tilt angles of the resin plate front surface was positive (plus), it means that the front surface of the resin plate faces upward.

TABLE 1

| | Ball Types | (degrees) | (FIG. 12) | (Shore D) | (m/s) | (deg.) | (rpm) |
|---|---|---|---|---|---|---|---|
| 1 | X01z | 5 | (a) | — | 33.88 | 7.90 | 1334 |
| 2 | | | (b) | 30 | 33.82 | 7.92 | 1532 |
| 3 | | | (c) | 30 | 33.72 | 8.20 | 1106 |
| 4 | | | (b) | 68 | 33.78 | 8.24 | 1380 |
| 5 | | | (c) | 68 | 33.72 | 8.20 | 1106 |
| 6 | | 10 | (a) | — | 33.76 | 16.16 | 2390 |
| 8 | | | (c) | 30 | 33.40 | 16.54 | 2194 |
| 9 | | 15 | (a) | — | 33.70 | 22.74 | 3638 |
| 11 | | | (c) | 30 | 33.60 | 23.66 | 3206 |
| 12 | PHYZ | 5 | (a) | — | 33.32 | 8.70 | 1056 |
| 13 | | | (b) | 30 | 33.48 | 8.46 | 1260 |
| 14 | | | (c) | 30 | 33.36 | 8.02 | 974 |
| 15 | | | (b) | 68 | 33.40 | 8.62 | 1162 |
| 16 | | | (c) | 68 | 33.38 | 8.52 | 1002 |

As shown in Table 1, when the resin plate was in the rearward tilt structure shown in FIG. 12C, the spin amount decreased and the launch angle increased compared with the single plate structure in FIG. 12A. On the other hand, when the resin plate was in the frontward tilt structure shown in FIG. 12B, the spin amount increased compared with the single structure in FIG. 12A.

Based on the above, it is verified that the spin amount of balls decreases as configured in the first invention structure (or resin plate rearward structure) the spin amount of balls increases as configured in the second invention structure (resin plate frontward structure).

What is claimed is:

1. A golf club head, comprising:

a head body that has a recess part at a front portion thereof, a face plate that is in a plate shape and arranged in the recess of the head body, a front surface of the face plate being for hitting a ball, and an elastic body that is made of an elastically deformable material and intervenes between the head body and the face plate, the elastic body being fixed to the head body and the face plate so that the face plate is slidable in the recess with respect to the head body, wherein a hardness of the material of the elastic body is equal to or greater than Shore A Hardness 10 and equal to or smaller than Shore D Hardness 80, a front side elastic body arrangement surface of the head body to which the elastic body is fixed is not parallel to the front surface of the face plate, the golf club head is an iron type golf club head, and an upper edge of the elastic body is arranged closer to a bottom of the head body than an upper edge of the face plate is, the upper edge of the elastic body, the upper edge of the face plate and the bottom of the head body being determined is an up-down direction (Z) of the golf club head.

2. The golf club head of claim 1, wherein a back surface of the face plate, to which the elastic body is fixed, is formed not to be parallel to the front surface of the face plate.

3. The golf club head of claim 2, wherein the back surface of the face plate and the front side elastic body arrangement surface of the head body are parallel.

4. The golf club head of claim 2, wherein a thickness of the face plate decreases as it approaches the bottom of the head body from the upper edge of the face plate.

5. The golf club head of claim 2, wherein the front and back surfaces of the face plate are both plane, and an intersectional angle θ, which is determined with the front and back surfaces of the face plate that are not parallel, is ranged between and including 2° and 70°.

6. The golf club head of claim 2, wherein a thickness of the face plate increases as it approaches the upper edge of the face plate from the bottom of the head body.

7. The golf club head of claim 1, wherein a back surface of the face plate, to which the elastic body is fixed, is formed to incline by a tilt angle in a clockwise direction from the front surface of the face plate, the clockwise direction being determined in a view from a heel side of the golf club head in a toe-heel direction of the golf club head.

8. The golf club head of claim 7, wherein the tilt angle of the back surface is ranged between and including 2° and 70°.

9. The golf club head of claim 1, wherein a back surface of the face plate, to which the elastic body is fixed, is formed to incline by a tilt angle in an anticlockwise direction from the front surface of the face plate, the anticlockwise direction being determined in a view from a heel side of the golf club head in a toe-heel direction of the club head.

10. The golf club head of claim 9, wherein the tilt angle is ranged between and including 2° and 70°.

11. The golf club head of claim 1, wherein a thickness of the elastic body is even.

12. The golf club head of claim 1, wherein a thickness of the elastic body is ranged between and including 0.1 mm and 5 mm.

13. The golf club head of claim 1, wherein the elastic body is made of urethane resin.

* * * * *